US008393655B2

(12) United States Patent
Barge et al.

(10) Patent No.: US 8,393,655 B2
(45) Date of Patent: Mar. 12, 2013

(54) SLAM CATCH FOR TRAILER GATES AND THE LIKE

(75) Inventors: Gerald Barge, S. Sioux City, NE (US); Mark Grunewald, Sioux City, IA (US)

(73) Assignee: Wilson Trailer Corporation, Sioux City, IA (US)

( * ) Notice: Subject to any disclaimer, the term of this patent is extended or adjusted under 35 U.S.C. 154(b) by 413 days.

(21) Appl. No.: 12/659,195

(22) Filed: Feb. 26, 2010

(65) Prior Publication Data

US 2011/0210569 A1 Sep. 1, 2011

(51) Int. Cl.
*E05B 15/02* (2006.01)
*E05B 15/00* (2006.01)

(52) U.S. Cl. ..... 292/341.17; 292/340; 292/341.15

(58) Field of Classification Search ..... 292/219, 292/220, 227, 228, 340, 341.15, 341.17, 292/DIG. 4, DIG. 15, DIG. 17; 49/275, 364, 49/379, 394; 16/388; 296/186.7
See application file for complete search history.

(56) References Cited

U.S. PATENT DOCUMENTS

| | | | | | |
|---|---|---|---|---|---|
| 333,022 | A | * | 12/1885 | Morton | 292/341.17 |
| 1,491,206 | A | * | 4/1924 | Fritz | 16/85 |
| 1,945,257 | A | * | 1/1934 | Cook | 292/254 |
| 2,872,232 | A | * | 2/1959 | Lawson | 292/80 |
| 2,883,699 | A | * | 4/1959 | Gross | 16/302 |
| 3,131,958 | A | * | 5/1964 | Dunckel | 292/99 |
| 3,288,508 | A | * | 11/1966 | Maize et al. | 292/128 |
| 4,261,605 | A | * | 4/1981 | Hock | 292/228 |
| 4,648,637 | A | * | 3/1987 | Walter | 292/128 |
| 6,007,116 | A | * | 12/1999 | Mott | 292/145 |
| 6,331,030 | B1 | * | 12/2001 | Geiger | 296/146.9 |
| 6,595,564 | B1 | * | 7/2003 | Hanchett et al. | 292/341.16 |

* cited by examiner

*Primary Examiner* — Carlos Lugo
(74) *Attorney, Agent, or Firm* — Jacobson Holman PLLC

(57) ABSTRACT

A slam catch that holds a side-load trailer gate or door in a closed position relative to the body of a trailer having a primary gate closure mechanism by which the trailer gate is fully secured in the closed position. The slam catch includes a catch hinge mounted on the body of the trailer, a latch mounted on the trailer gate, and a catch pivotally coupled to the catch hinge and configured to automatically engage the latch when the trailer gate is moved toward the closed position. The engagement of the catch with the latch holds the trailer gate in a closed position so that an operator can secure the primary gate closure mechanism without having to physically hold the gate closed.

19 Claims, 13 Drawing Sheets

SLAM CATCH FOR TRAILER GATES AND THE LIKE

BACKGROUND OF THE INVENTION

1. Field of the Invention

The present invention is related to the field of catches and latches for gates and, more particularly, to a slam catch for temporarily securing a livestock trailer gate in a closed position until the primary gate closure mechanism can be secured.

2. Description of the Related Art

Livestock trailers often have a side load door or gate that swings on a vertical axis to open and close the gate through which the livestock are loaded onto the trailer. When loading livestock, it is often desirable to be able to secure the gate in a closed position quickly as the livestock, once loaded into the trailer enclosure, may attempt to exit back through the gate. In many cases, the trailer's gate closure mechanism requires the person loading the livestock to physically hold the gate closed while moving a rotatable arm or other structure on the trailer that slides a lock rod or similar structure into a receiving opening in the door to secure the door in the closed position. However, this can be difficult to accomplish if the livestock are pressing against the inside of the door, particularly if only one or two persons are available to complete the loading process.

Accordingly, a need exists for a slam catch that can be engaged easily and which will hold the gate of a livestock trailer in a closed position until the person loading the livestock can secure the primary gate closure mechanism.

SUMMARY OF THE INVENTION

In view of the foregoing, one object of the present invention is to overcome the difficulties of loading livestock into a trailer and getting the trailer gate closed behind them quickly and securely.

Another object of the present invention is to provide a slam catch for a side-load (vertically oriented) trailer gate that quickly engages with minimal force to hold the trailer gate in a closed position.

A further object of the present invention is to provide a slam catch in accordance with the preceding objects that is "slam" activated to allow the gate to be secured in the closed position in a simple and uncomplicated manner.

Yet another object of the present invention is to provide a slam catch in accordance with the preceding objects that catches and holds the gate, allowing a trailer operator to further secure the trailer's primary gate closure mechanism without having to physically hold the gate closed.

A still further object of the present invention is to provide a slam catch in accordance with the preceding objects that still retains the trailer gate in a fully closed position after the primary gate closure mechanism has been released.

Another object of the present invention is to provide a slam catch in accordance with the preceding objects that can be easily released by an operator immediately before opening the gate to unload the livestock from the trailer.

Yet a further object of the present invention is to provide a slam catch for a trailer gate or other door that is not complex in structure and which can be manufactured at low cost but yet effectively and easily secures the gate or door in a closed position without the operator having to hold the door closed and thereafter is easily released to allow the gate to be opened.

A still further object of the present invention is to provide a slam catch in accordance with the preceding objects that can be readily adapted to accommodate manufacturing dimensional variations in the trailer to which the slam catch is mounted.

In view of these and other objects and advantages, the present invention is directed to a slam catch for a trailer gate, such as the rear side-load gate on a livestock trailer through which the livestock are loaded. As is known, the trailer gate has a primary gate closure mechanism by which the gate is secured in the closed position to the body of the trailer for transport of the livestock.

The slam catch of the present invention includes a catch hinge mounted on the body of the trailer, a latch mounted on the trailer gate, and a catch pivotally mounted to the catch hinge that automatically engages the latch when the trailer gate is moved toward the closed position so that an operator can secure the primary gate closure mechanism without having to physically hold the gate closed.

More particularly, the catch hinge is mounted to an interior surface of the trailer and has an outwardly directed face. The catch has a main body that extends rearwardly, from a pivot end coupled to the catch hinge, to a catch end adjacent the trailer gate. The catch end includes a hook that curves in a direction away from the face of the catch hinge.

While the hinged connection between the catch hinge and the pivot end of the catch allows the catch main body to assume a position that is generally parallel with the main face of the catch hinge, the catch is biased away from the face of the catch hinge by a spring mechanism positioned between the face of the catch hinge and an adjacent side of the catch main body.

Extending from the same side as the spring mechanism, an arm extends outwardly from the catch main body to pass through a U-shaped cutout in the catch hinge, after which the arm curves to extend rearwardly. The arm is long enough so that the rearwardly extending end thereof passes through an aperture in the back wall of the trailer so as to be accessible to an operator who is outside the trailer by the gate.

The latch is mounted to the gate in horizontal alignment with the catch hinge mounted on the trailer. The outer side of the latch facing the catch hinge has an indent with a radiused lip at the deepest side or base of the indent that forms a front edge thereof. From the base of the lip, the indent slopes upwardly toward a rear edge of the latch to form a ramped surface. The rear edge of the latch includes a second radiused lip.

As the trailer gate is moved to a closed position, the hook on the catch first engages the radiused lip on the indent, where the catch is held in the base and against the latch by the bias of the spring mechanism. As the door is fully closed, the catch end slides upwardly and rearwardly along the ramped surface while being forced into closer engagement therewith by the closing door. Upon reaching the rear edge of the latch, the catch end hook rides up and over the second radiused lip, locking the catch in a substantially parallel relationship with the latch.

To release the slam catch, the operator applies outward force to the rearwardly extending end of the arm which compresses the spring, moves the catch away from the latch and releases the catch end hook from the second radiused lip. Upon disengagement of the hook from the second radiused lip, the catch end hook, being biased toward the latch by the spring mechanism, slides downwardly and forwardly along the ramped surface toward the front edge of the indent where the hook is again engaged with the radiused lip on the indent. To fully release the slam catch, further outward pressure is applied to the rearwardly extending end of the arm to disengage the hook end from the indent radiused lip.

Accordingly, the slam catch is able to hold the gate in a closed position both before and after the primary gate closure mechanism is engaged.

Other advantages of the present invention which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
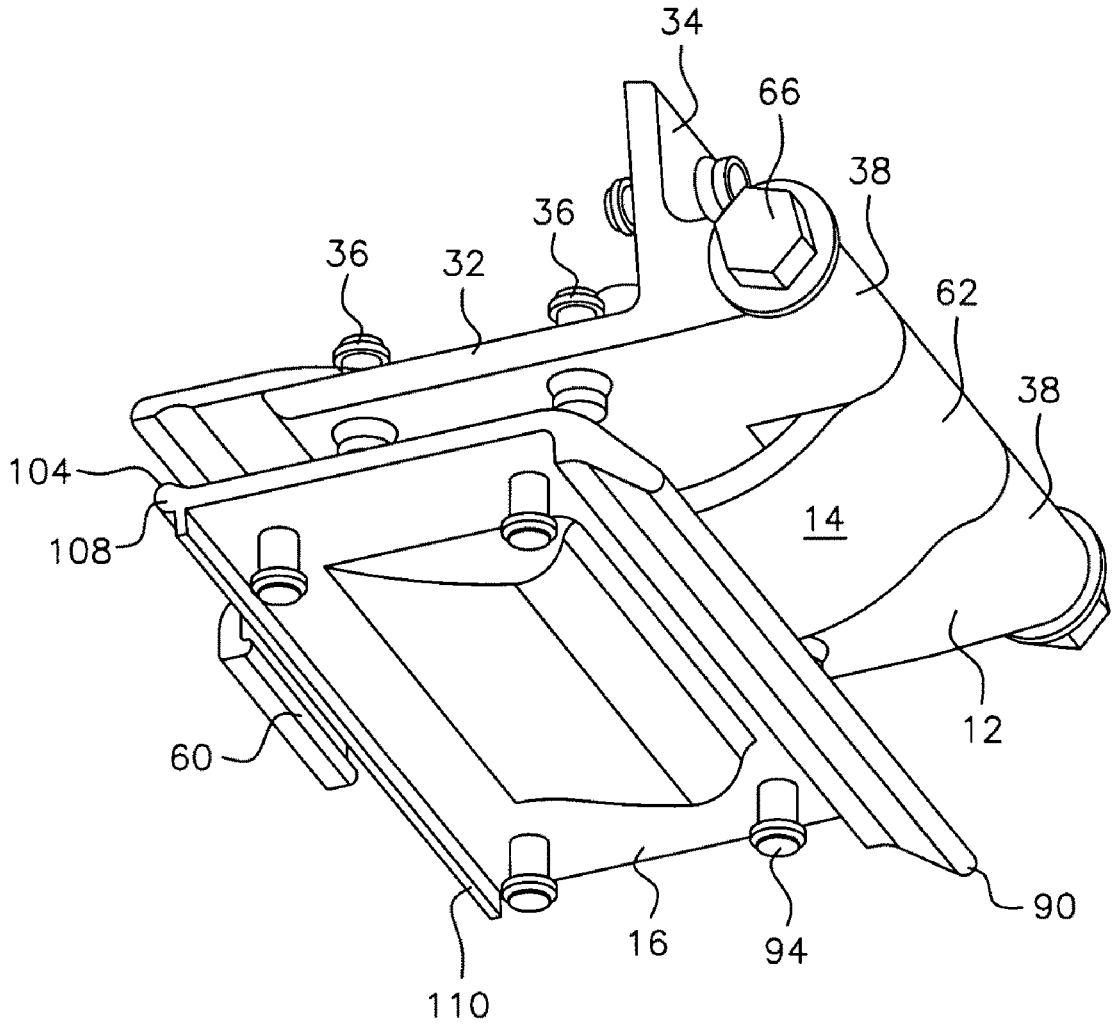
FIG. 1 is a top perspective view from the gate side of a slam catch in accordance with the present invention in the closed position.
Figure 2:
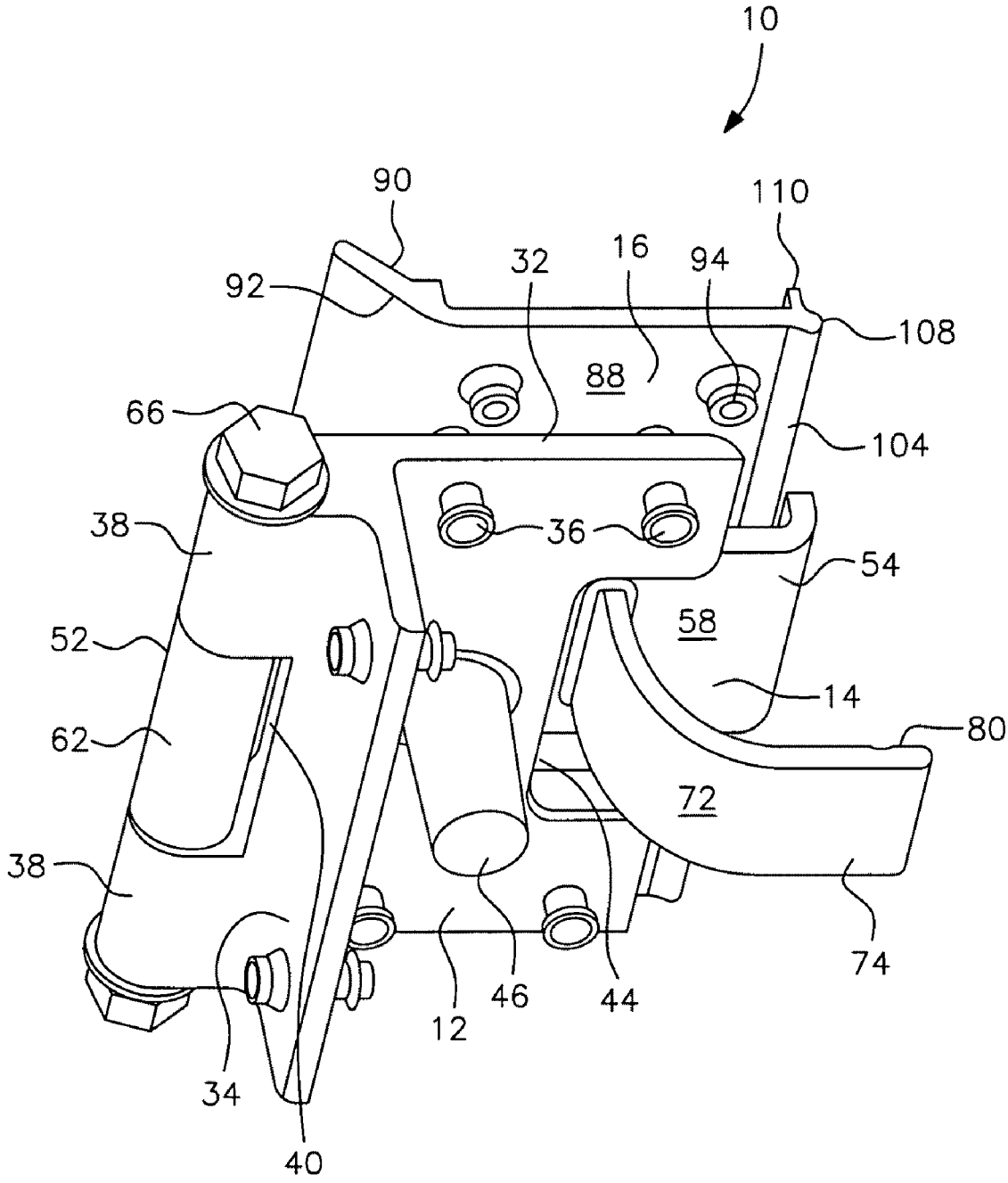
FIG. 2 is another top perspective view of the slam catch shown in FIG. 1 from the trailer wall side.
Figure 3:
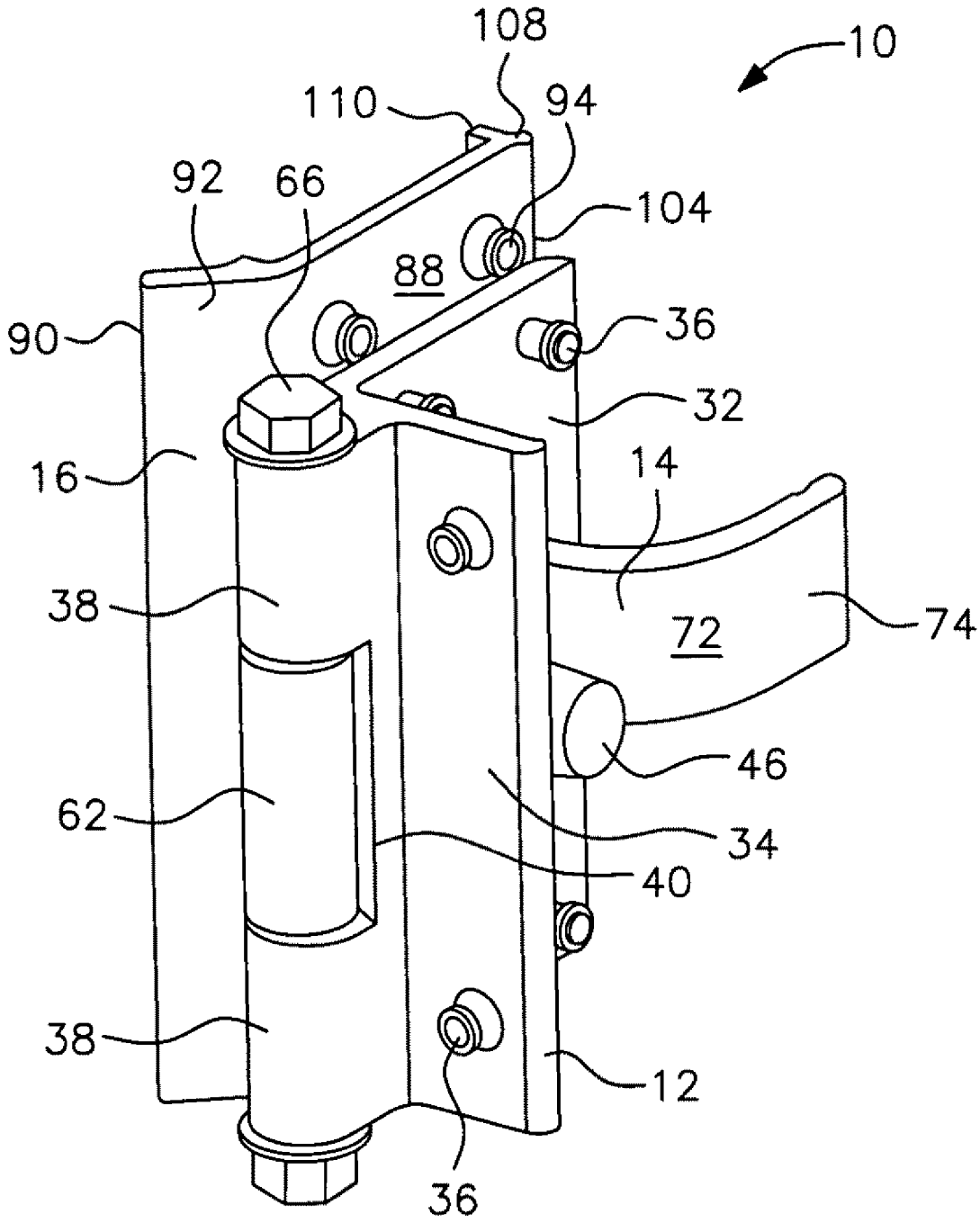
FIG. 3 is a side perspective view of the slam catch shown in FIGS. 1 and 2 from the trailer side.

Although only one preferred embodiment of the invention is explained in detail, it is to be understood that the embodiment is given by way of illustration only. It is not intended that the invention be limited in its scope to the details of construction and arrangement of components set forth in the following description or illustrated in the drawings. Also, in describing the preferred embodiments, specific terminology will be resorted to for the sake of clarity. It is to be understood that each specific term includes all technical equivalents which operate in a similar manner to accomplish a similar purpose.

As shown in FIGS. 1-6, the present invention is directed to a slam catch generally designated by reference numeral 10. The slam catch includes a catch hinge generally designated by reference numeral 12 and shown in FIGS. 7A-7E, a catch generally designated by reference numeral 14 and shown in FIGS. 8A-8D which is pivotally mounted to the catch hinge 12, and a latch generally designated by reference numeral 16 and shown in FIGS. 9A-9D.

Figure 10:
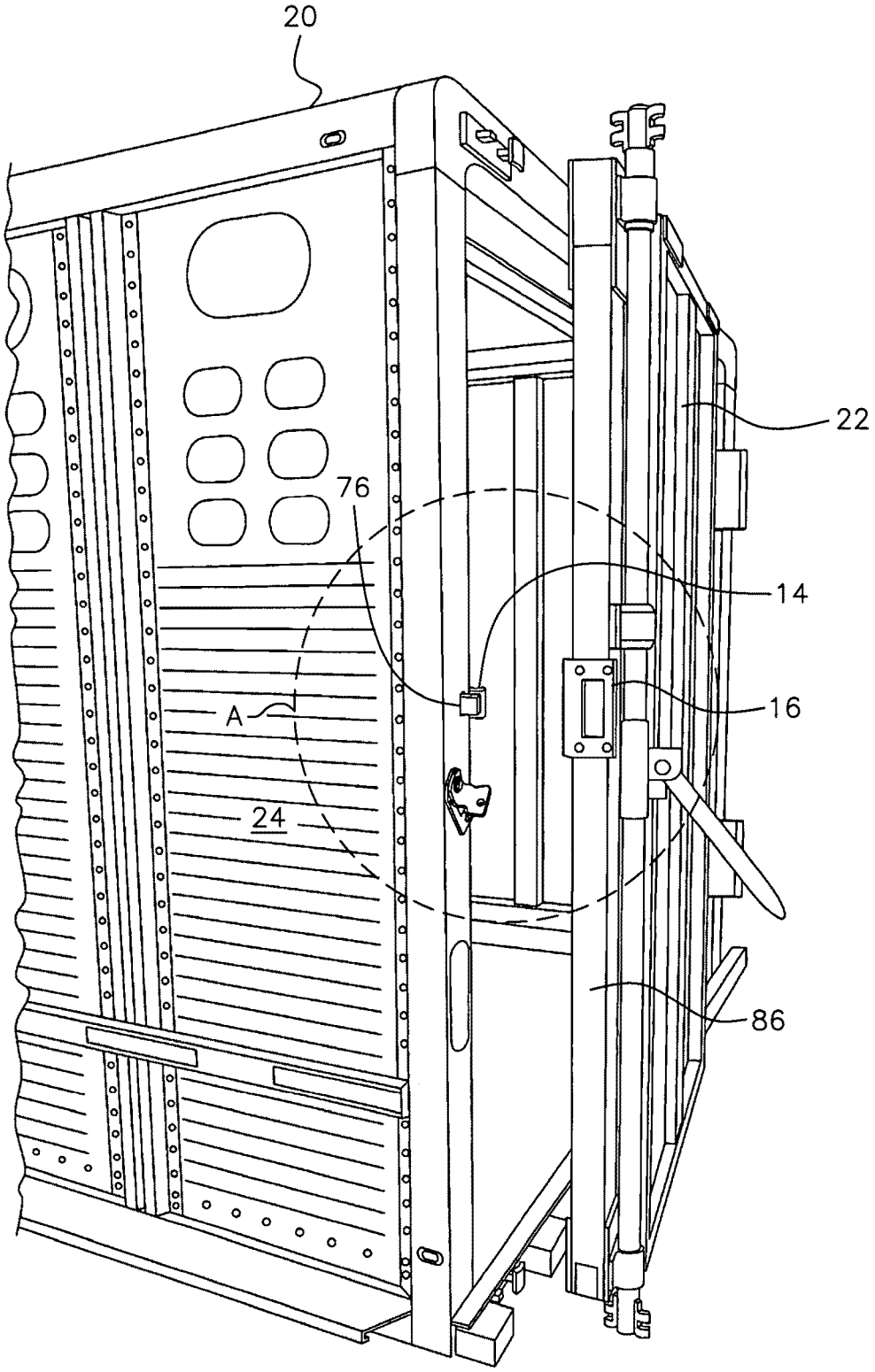
FIG. 10 is a perspective view of the slam catch according to the present invention as mounted on a trailer body and trailer gate.
Figure 10A:
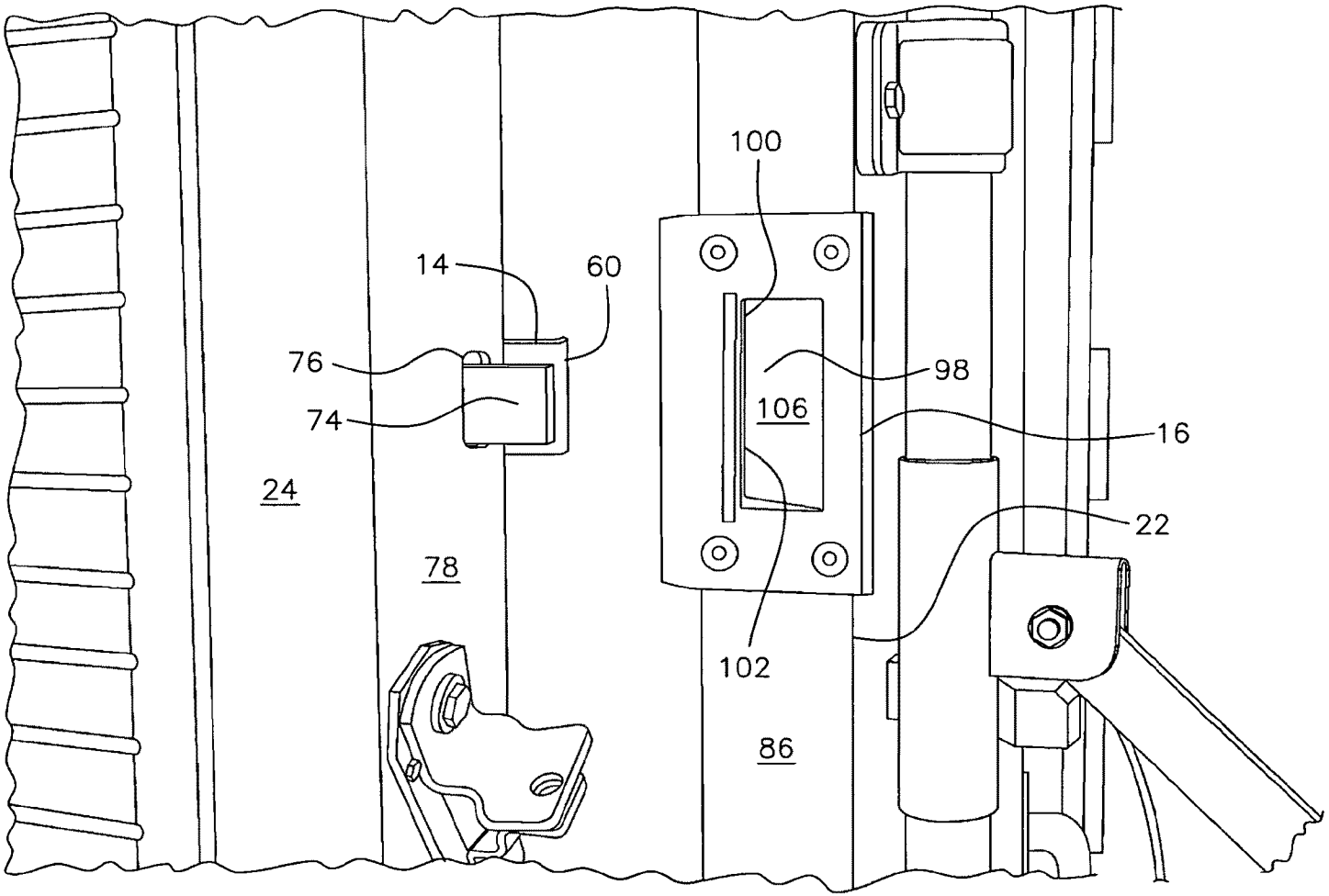
FIG. 10A is an enlarged view of Detail A of FIG. 10.
Figure 11:
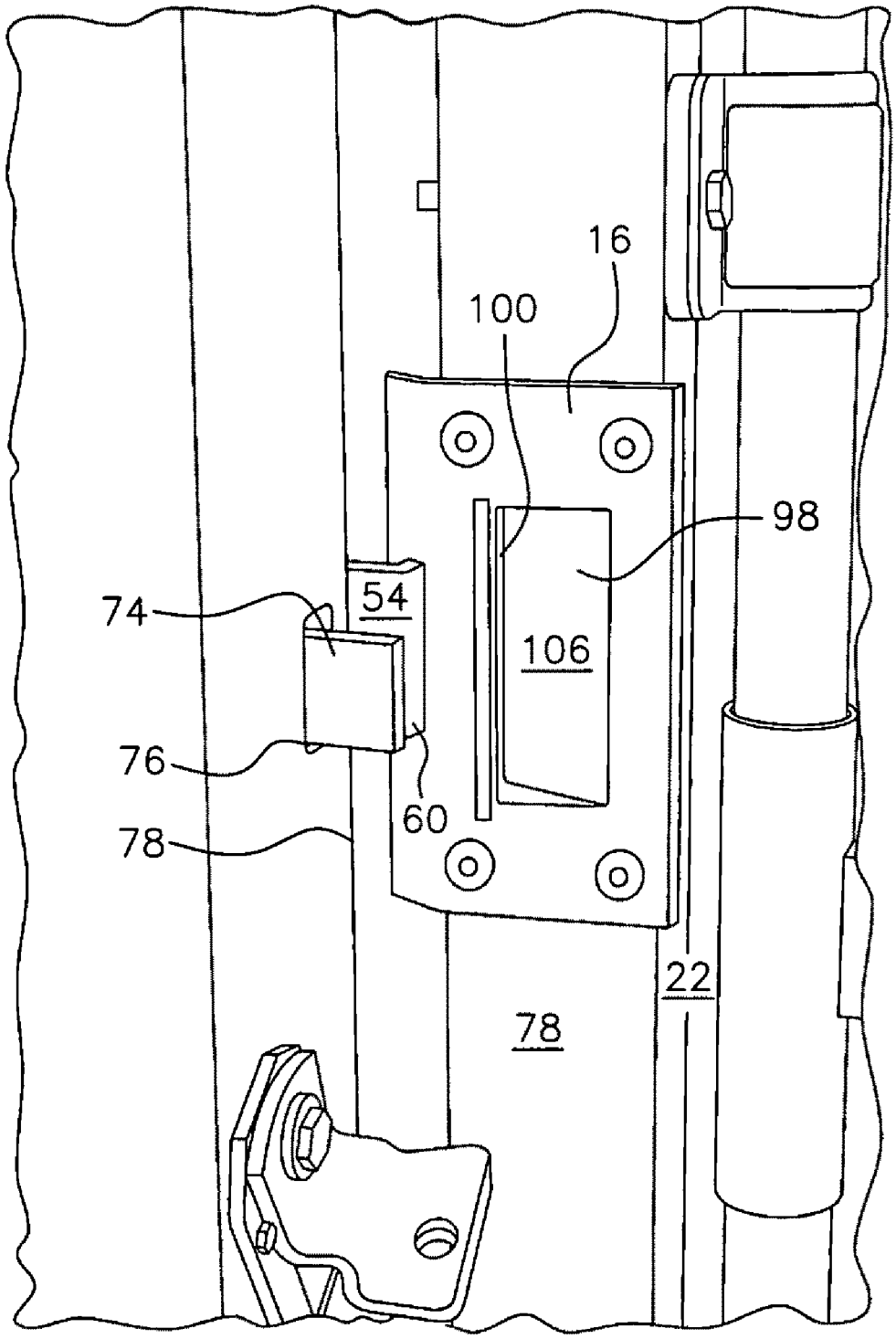
FIG. 11 is a second view of the subject matter of Detail A of FIG. 10 with the gate moved closer to the closed position than as shown in FIG. 10A.
Figure 14:
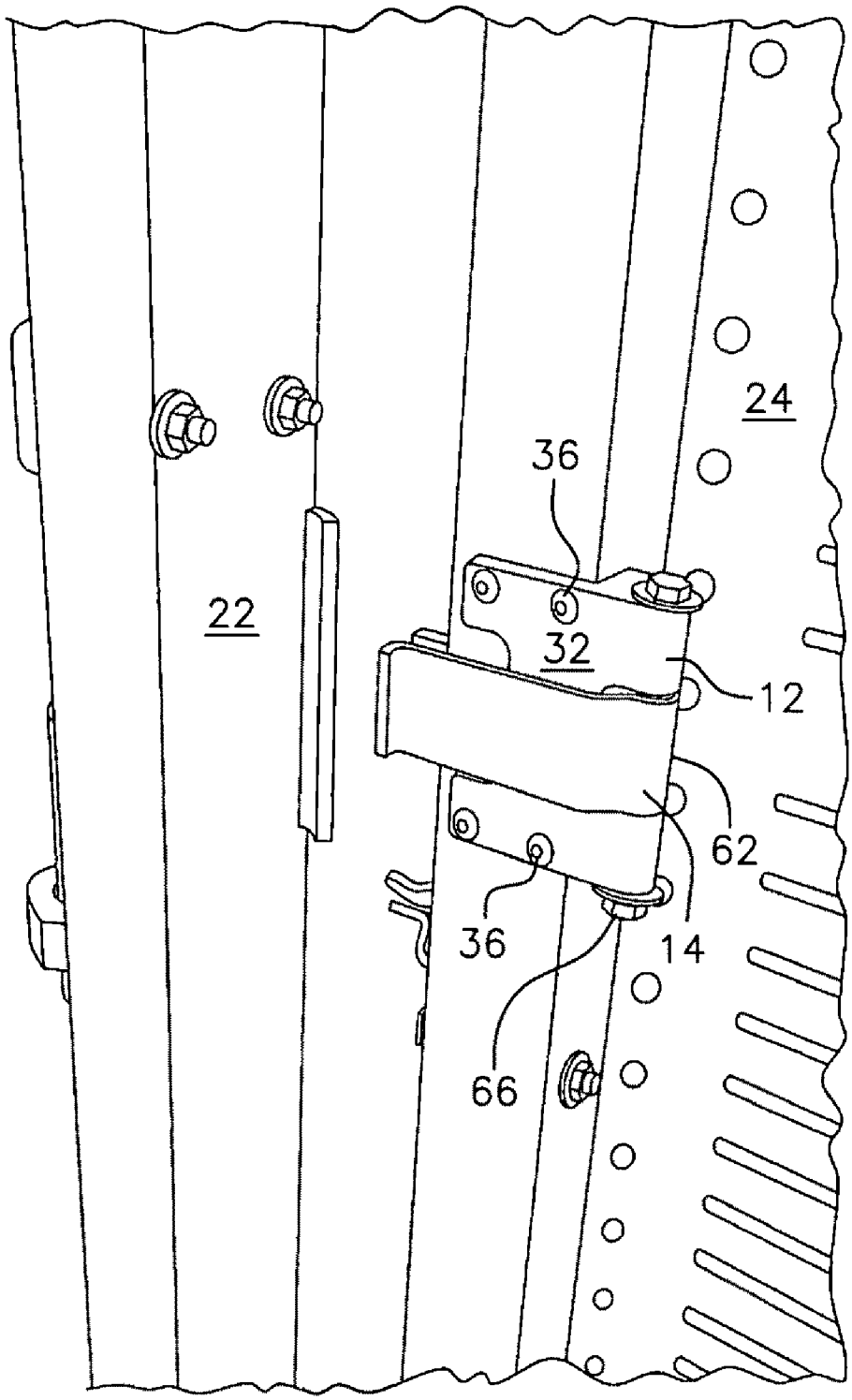
FIG. 14 is a view of the subject matter of Detail A of FIG. 10 but shown from inside the trailer as the gate is nearly closed.

As described herein, the slam catch 10 of the present invention can be used in a number of different applications that include the need to secure side-load doors in a closed position. However, according to the preferred embodiment described herein, the slam catch 10 is mounted on a trailer 20 having a rear gate 22 (see FIG. 10) through which livestock or other materials to be hauled, whether animate or inanimate, are loaded. In this embodiment, the catch hinge 12 with the catch 14 pivotally connected thereto is mounted on the inside of the trailer 20 (see FIG. 14), and the latch 16 is mounted on the trailer gate 22 as shown in FIGS. 10 and 10A. As the trailer gate 22 is closed, progressively shown in FIGS. 11-14, the catch 14 automatically engages the latch 16 so that an operator can secure the trailer's primary gate closure mechanism (not shown) without having to physically hold the gate closed as will be described more fully hereinafter.

As used herein, the terms "rear" or "rearwardly" and "front" or "forwardly" are used with reference to the corresponding parts of the trailer 20. Hence, the front of the trailer is that part of the trailer that is nearest the towing vehicle, while the rear of the trailer is the end opposite the front. In the embodiment described herein, the gate through which the trailer is entered is at the rear of the trailer. There are, of course, trailers in which the gate is positioned on the side of the trailer for which the slam catch would be equally applicable. However, a rear gate such as that shown in FIG. 10 provides the best case for ease of description as the gate is in the rearmost position with the remainder of the trailer being "forward" with respect thereto.

Returning to the components of the slam catch 10 in detail, the catch hinge 12 is shown as assembled with the catch 14 and latch 16 in FIGS. 1-6, and in isolation in FIGS. 7A-7E.

The catch hinge 12 includes an L-shaped mounting element 30 having a main face 32 that is mounted to the inside of the trailer to be generally parallel with the trailer side wall 24, and a secondary face 34 that is generally perpendicular to the main face 32. Both the main face 32 and the secondary face 34 are fixedly mounted to the trailer 20 by fastening components 36 in a manner known by persons skilled in the art.

Two hinge arms 38 project forwardly from, and in linear alignment with, the main face 32. The hinge arms 38 are parallel with and spaced from one another to define a gap 40 therebetween. Each of the hinge arms 38 has a bore 42 therethrough that extends transverse to the projecting direction of the arms 38. The bore 42 of each are 38 aligns with the bore 42 of the opposing hinge arm 38, albeit separated at a space therefrom by the gap 40.

Figure 7A:
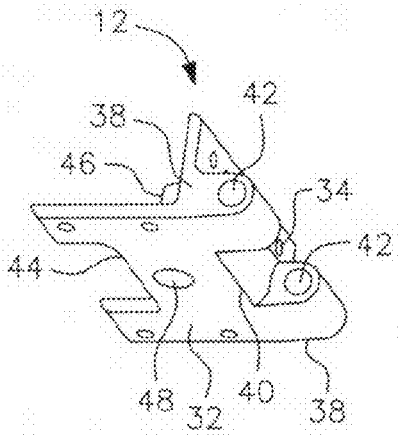
FIG. 7A is a perspective view of the catch hinge of the slam catch shown in FIGS. 1-6.
Figure 7B:
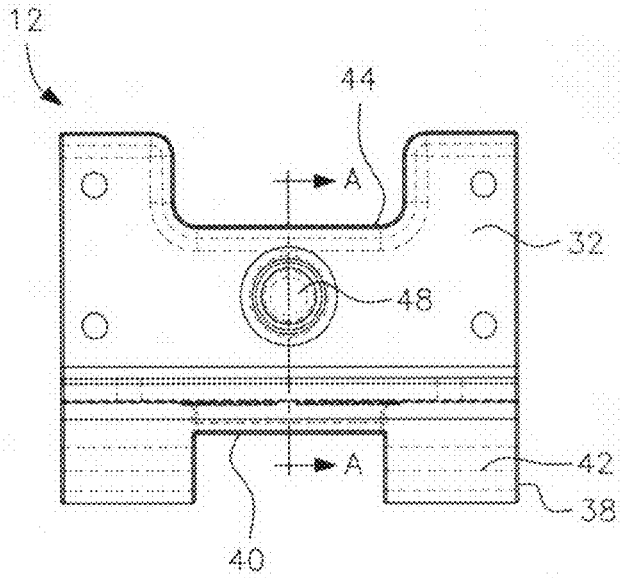
FIG. 7B is a view of the main face of the catch hinge shown in FIG. 7A.
Figure 7C:
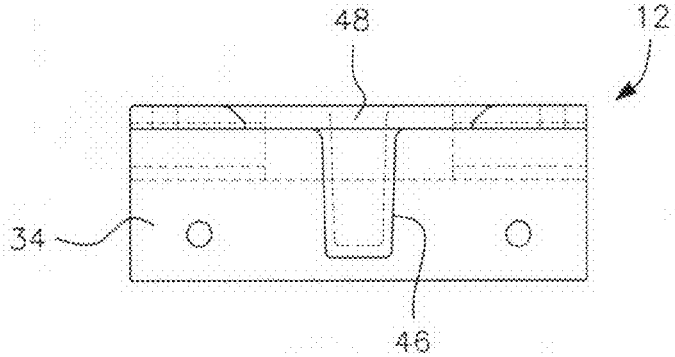
FIG. 7C is a view of the rear face of the catch hinge shown in FIG. 7A.
Figure 7D:
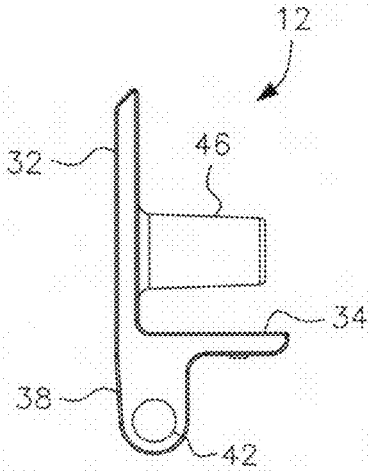
FIG. 7D is a side view taken along line D-D of the catch hinge shown in FIG. 7B.
Figure 7E:
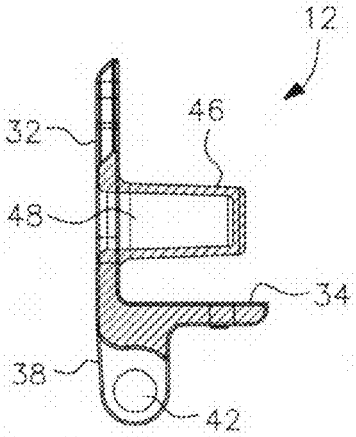
FIG. 7E is a cross-sectional view taken along line A-A of the catch hinge shown in FIG. 7B.
Figure 8A:
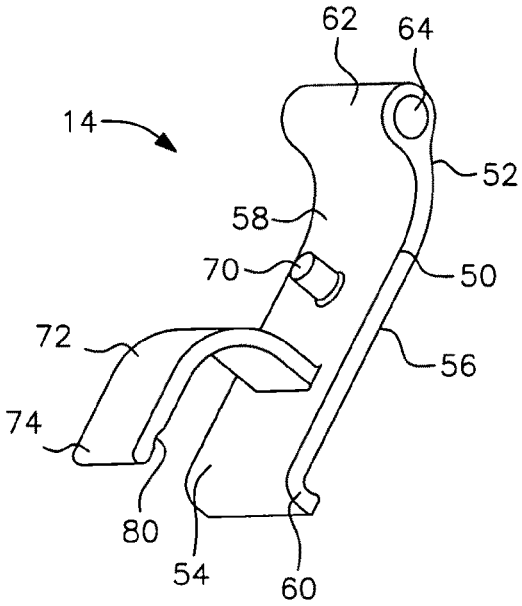
FIG. 8A is a perspective view of the catch of the slam catch shown in FIGS. 1-6.
Figure 8D:
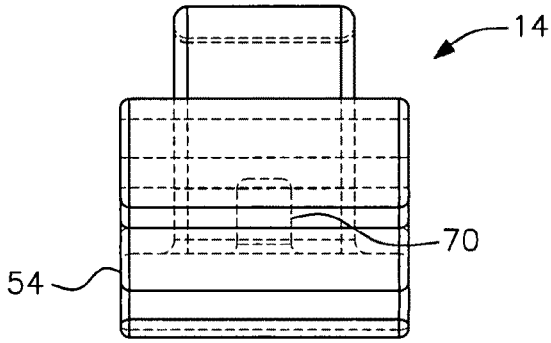
FIG. 8D is an end view of the catch shown in FIG. 8C.
Figure 8B:
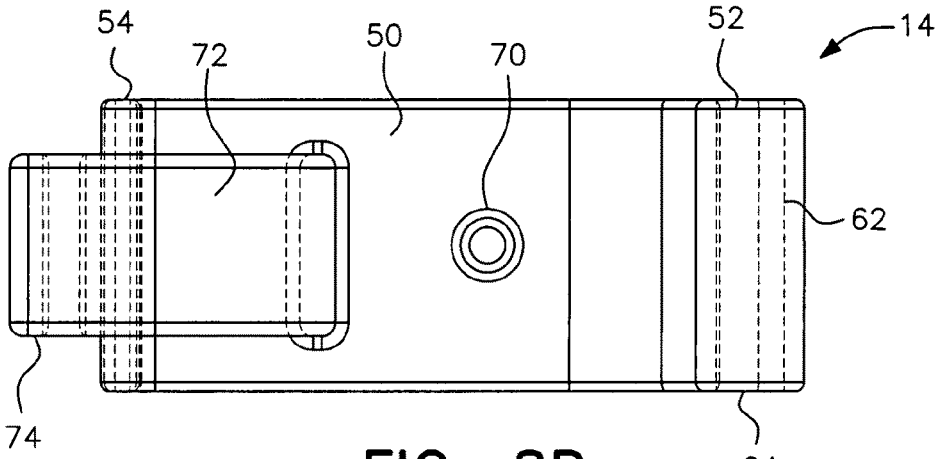
FIG. 8B is a view of the outward side of the catch hinge shown in FIG. 8A.
Figure 8C:
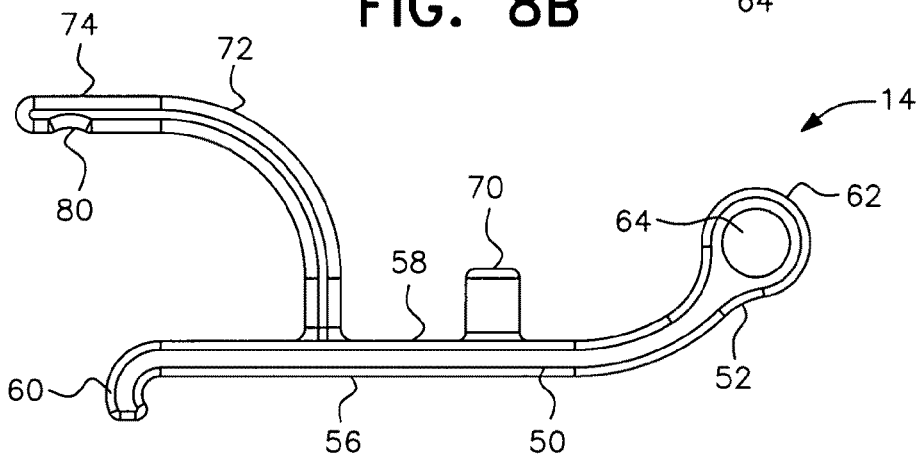
FIG. 8C is a side view taken along line C-C of the catch shown in FIG. 8B.
Figure 9A:
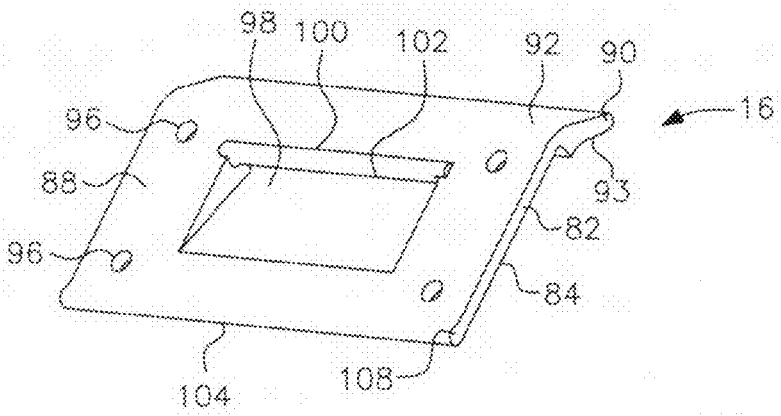
FIG. 9A is a perspective view of the latch of the slam catch shown in FIGS. 1-6.
Figure 9C:
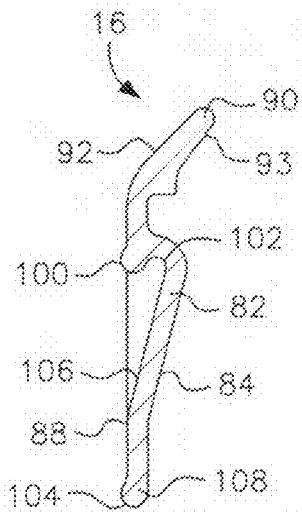
FIG. 9C is a cross-sectional view taken along line A-A of the latch shown in FIG. 9B.
Figure 9B:
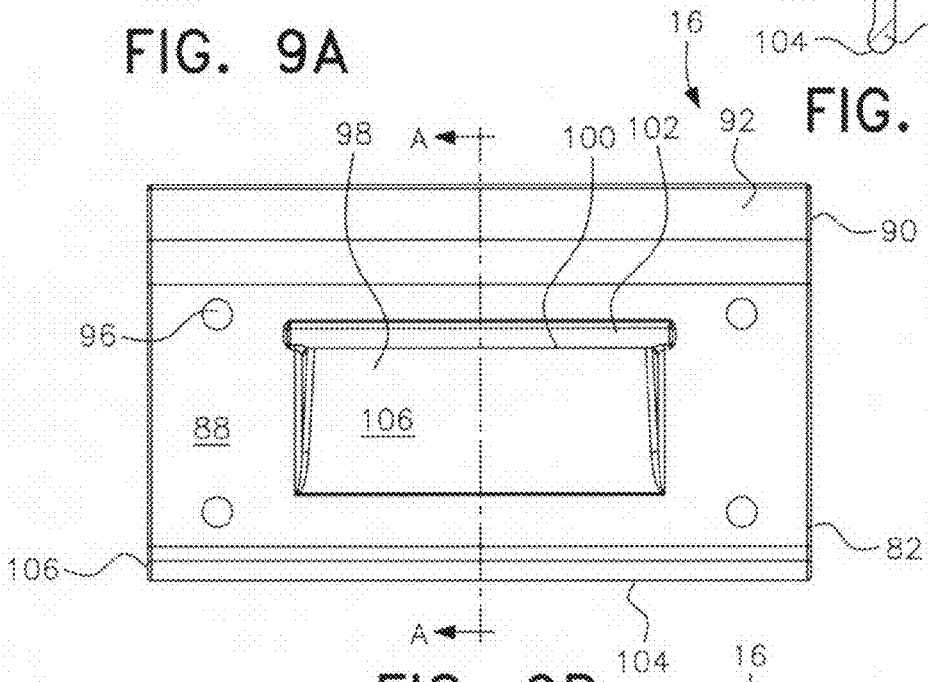
FIG. 9B is a view of the outward side of the latch shown in FIG. 9A.
Figure 9D:
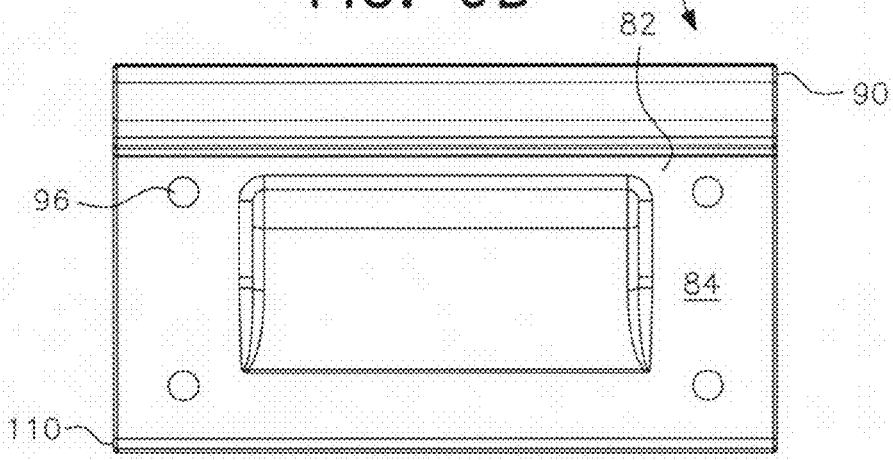
FIG. 9D is a view of the inward side of the latch shown in FIG. 9A.

The main face 32 includes a U-shaped cutout 44 that, in combination with the hinge arms 38, gives the main face 32 a generally H-shaped planar configuration as shown in FIG. 7B. A tubular member 46 extends laterally outwardly from about the center of the H-shaped main face 32, and toward the side wall 24 of the trailer 20 when the hinge 12 is mounted on the trailer, so as to be generally parallel with the secondary face 34 of the hinge 12. A blind bore 48 is formed in the center of the tubular member 46 which is open at the main face 32 of the hinge 12.

The catch 14 is shown as assembled with the catch hinge 12 and latch 16 in FIGS. 1-6, and in isolation in FIGS. 8A-8D. The catch 14 includes a main body 50 having a pivot end 52 and a catch end 54. When the slam latch 10 is mounted to the trailer 20, the pivot end 52 is coupled to the catch hinge 12 with the longitudinal length of the main body 50 extending rearwardly from the pivot end 52 to the catch end 54 which is adjacent the trailer gate 22. With respect to this mounted position, the main body 50 has an inward side 56 that faces the center of the trailer and an outward side 58 that is opposite the inward side 56 so as to face the side wall 24 of the trailer 20. The catch end 54 of the main body 50 includes a hook 60 that curves toward the inward side 56 of the main body 50 and thus away from the main face 32 of the catch hinge 12.

The pivot end 52 of the main body 50 has a generally tubular head 62 with a bore 64 therethrough that is transverse to the longitudinal length of the main body 50. The head 62 fits within the gap 40 between the hinge arms 38 such that the bore 64 in the head 62 is brought into alignment with the hinge arm bores 42. A fastening element 66 is inserted into the aligned bores 42, 64 and secured to pivotally mount the catch 14 to the hinge 12.

The hinged connection between the catch hinge 12 and the pivot end 52 of the catch 14 allows the catch main body 50 to assume a position that is generally parallel with the main face 32 of the catch hinge 12. The catch 14, however, is biased away from the main face 32 of the catch hinge 12 by a spring mechanism positioned between the main face 32 of the catch hinge 12 and the outward side 58 of the catch main body 50.

More particularly, a tubular boss 70 extends laterally from the outward side 58 of the main body 50, and toward the side wall 24 of the trailer when the hinge 12 and catch 14 are mounted on the trailer 20. A compression spring (not shown) is fitted onto the boss 70 with a friction fit. The tubular boss 70 with the spring mounted thereon is sized to fit into the blind bore 48 formed in the tubular member 46 on the hinge 12. The spring therefore biases the catch 14 away from the hinge 12.

In addition to the boss 70, an arm 72 projects laterally outward from the outward side 58 of the main body 50 and then curves to extend rearwardly toward the back of the trailer. With this configuration, the arm 72 is received within the U-shaped cutout 44 in the catch hinge 12 so as to allow the catch 14, upon appropriate compression of the spring mechanism, to pivot into an orientation in which the catch main body 50 is generally parallel with the hinge main face 32. The arm 72 is long enough so that the rearwardly extending end 74 thereof passes through an aperture 76 formed in the back wall 78 of the trailer 20 to project outside the trailer. The projecting end 74 of the arm 72 thereby acts as a handle which is accessible to an operator who is outside the trailer by the gate. While not necessary, according to a preferred embodiment, the inner side of the arm adjacent the end 74 has a concavity 80 formed therein which makes the handle end 74 ergonomically more comfortable for the operator to grasp and manipulate as will be further described hereinafter.

The latch 16 is shown as assembled with the catch 14 and catch hinge 12 in FIGS. 1-6, and in isolation in FIGS. 9A-9D. As shown in FIG. 10, the latch 16 is mounted to the trailer gate 22 in horizontal alignment with the catch hinge 12 mounted on the back wall 78 of the trailer 20.

The latch 16 has a body 82 that includes an inward side 84 that is in abutment with the edge 86 of the gate 22 when the latch is mounted thereto, and an outward side 88 that is opposite the inward side 84 and which faces the main face 32 of the catch hinge 12 when the slam catch 10 is mounted on the trailer 20. The forward edge 90 of the latch 16 is preferably curved away from the outward side 88 to create a sloped outer surface 92 and a slightly concave inner surface 93, although this is not required. The latch 16 is secured to the edge 86 of the gate 22 by a plurality of fasteners 94 that are received within apertures 96 formed in the latch body 82.

The outward side 88 of the latch has an indent 98 formed therein with a radiused lip 100 at the front edge thereof. The lip 100 is over and spaced from the base 102 of the indent 98, with the base 102 being defined as the deepest area of the indent 98. From the base 102 below the lip 100, the indent slopes upwardly toward a rear edge 104 of the latch 16 to form a ramped surface 106.

Figure 4:
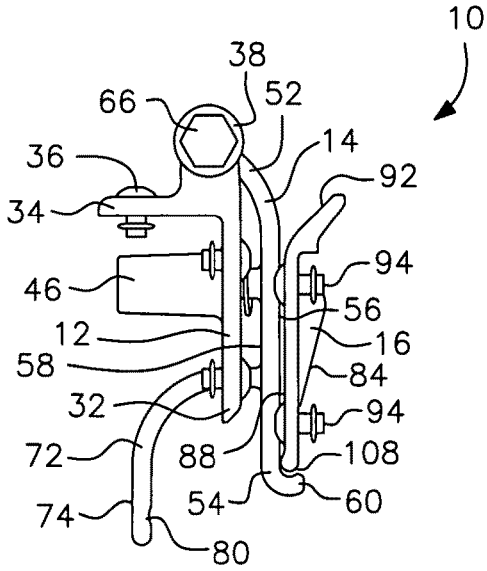
FIG. 4 is a side view of the slam catch shown in FIGS. 1-3.
Figure 5:
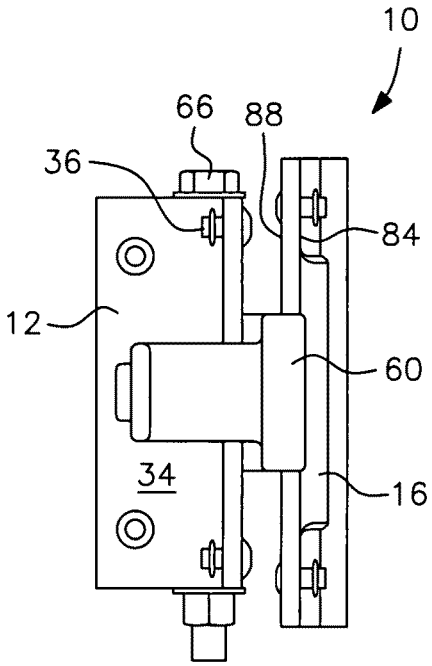
FIG. 5 is a bottom view of the slam catch shown in FIG. 4.
Figure 6:
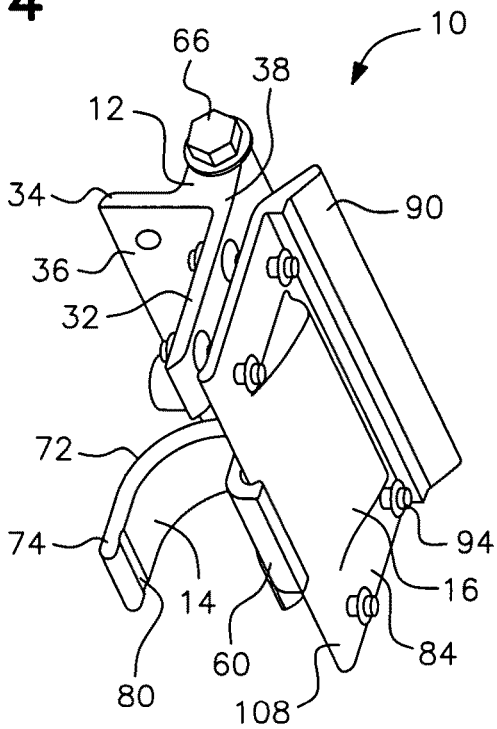
FIG. 6 is another perspective view of the slam catch shown in FIGS. 1-5.

The rear edge 104 of the latch includes a second radiused lip 108 that can optionally include a flange 110 that projects laterally toward the inward side 84 of the latch body 82. An outer curvature of the second radiused lip 108 is complementary to the inner curvature of the hook 60 on the catch hook end 54 of the catch 14 so that, when the gate is closed, the hook 60 is secured over and against the second radiused lip 108 as best seen in FIG. 4.

In use, as the trailer gate 22 is moved to a closed position, the hook 60 on the catch 14 first engages the radiused lip 100 on the indent 98, where the catch 14 is received into the base 102 and held against the ramped surface 106 on the outward side 88 of the latch 16 by the bias of the spring mechanism. As the door is fully closed, the catch end 54 slides upwardly and rearwardly along the ramped surface 106 while being forced into closer engagement therewith by the closing door 22. Upon reaching the rear edge 104 of the latch 16, the catch end hook 60 rides up and over the second radiused lip 108, locking the catch 14 in a substantially parallel relationship with the latch 16.

As is evident from the manner of operation described, the slam latch 10 does not have to be engaged slowly but may be secured by slamming the gate shut. This is advantageous when loading uncooperative livestock and also minimizes the effort required of the operator in completing the load and securing the trailer gate in the closed position since the operator does not have to hold the gate shut while securing the primary gate closure mechanism.

Figure 12:
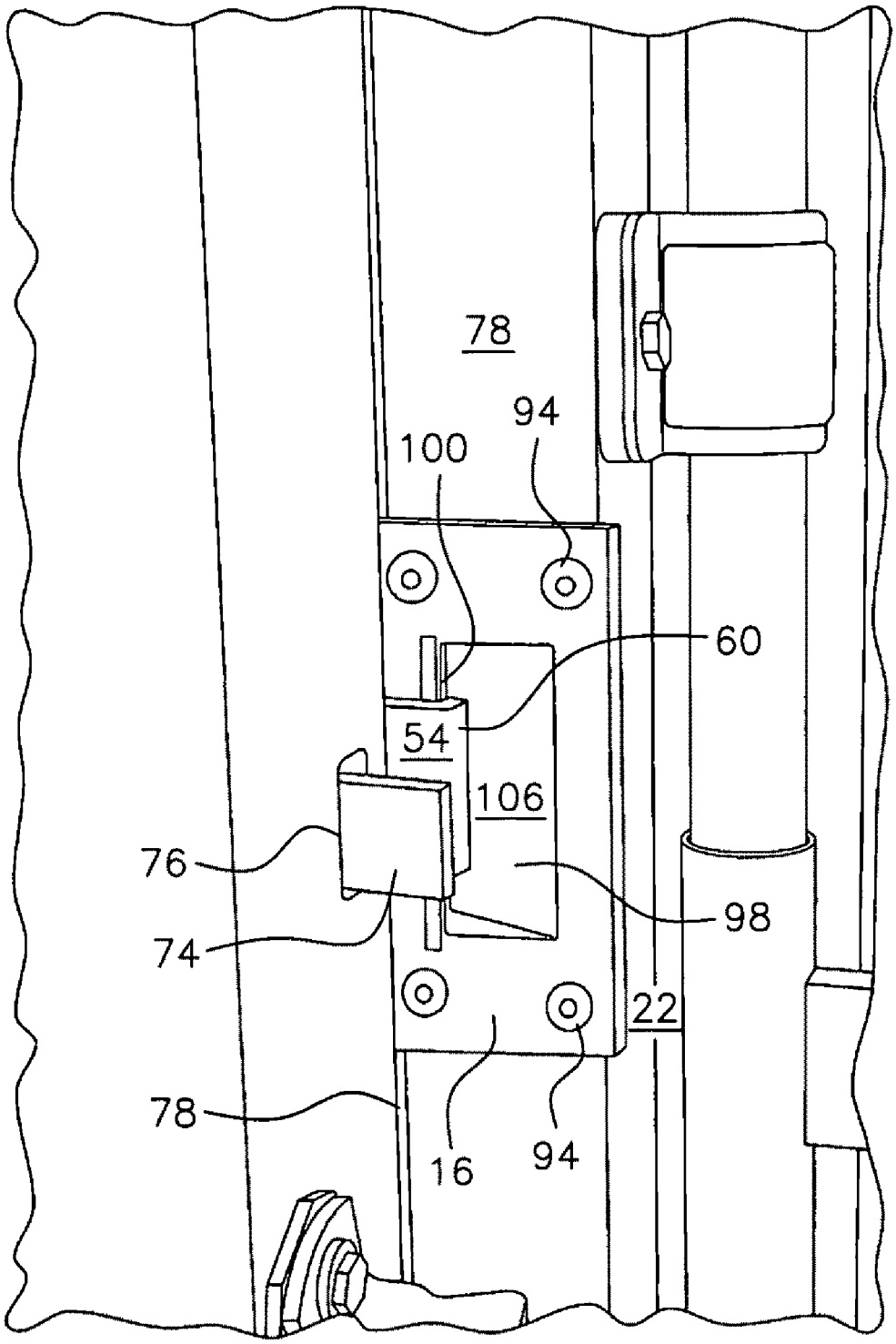
FIG. 12 is a third view of the subject matter of Detail A of FIG. 10 sequentially following from FIG. 11 with the catch on the trailer body beginning to engage the indent on the gate latch.
Figure 13:
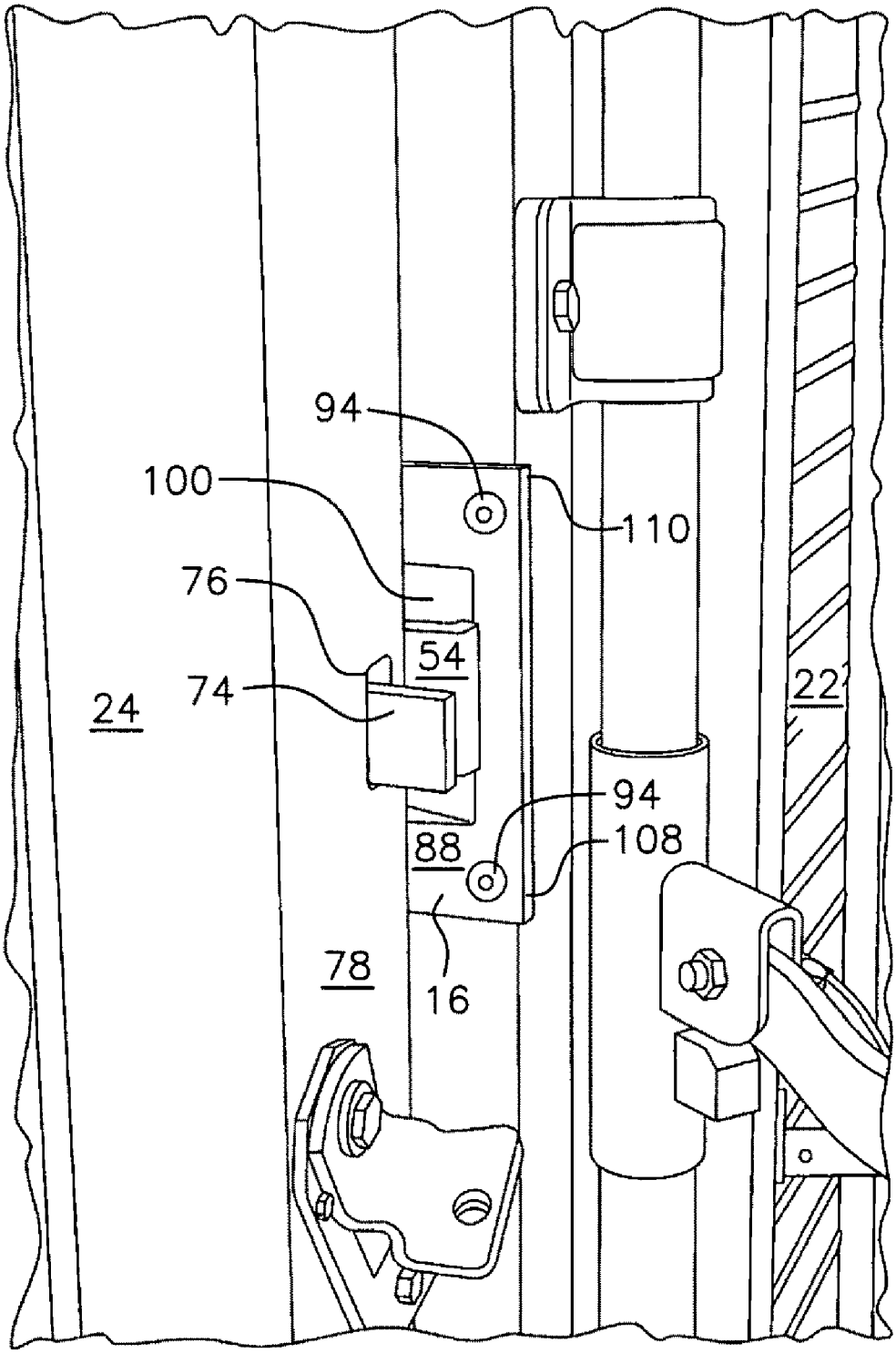
FIG. 13 is a fourth view of the subject matter of Detail A of FIG. 10 sequentially following from FIG. 12 with the catch leaving the indent to approach the rear edge of the latch.

To release the slam catch 10, the operator applies outward force to the handle end 74 of the rearwardly extending end of the arm as shown by the arrowed line in FIG. 12. This compress the spring mounted on the boss 70 and enclosed within the tubular member 46 and releases the catch end hook 60 from the second radiused lip 108. Upon disengagement of the hook from the second radiused lip, the catch end hook 60, being biased toward the latch 16 by the spring mechanism, slides downwardly and forwardly along the ramped surface 106 toward the base 102 of the indent 98 where the hook is again engaged with the radiused lip 100 on the indent. To fully release the slam catch, further outward pressure is applied to the handle end 74 of the arm 72, as again shown by the arrowed line in FIG. 12, to disengage the hook from the indent radiused lip 100.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. For example, the slam latch described herein may be used on any door that is secured to a fixed structure when the door is closed. Therefore, it is not desired to limit the invention to the specific example of a trailer gate as disclosed or the exact construction and operation shown and described. Rather, all suitable modifications and equivalents may be resorted to, falling within the scope of the invention.

What is claimed is:

1. A safety catch for holding a trailer gate or door in a closed position relative to the body of the trailer, said trailer including a primary gate closure mechanism by which the trailer gate is fully secured in the closed position, the safety catch comprising:

a catch hinge mounted on an inner surface of the body of the trailer, said catch hinge having a mounting face that is generally perpendicular to the trailer gate;

a latch mounted on the trailer gate; and a catch having a main body extending rearwardly from a pivot point coupled to the catch hinge to a catch end adjacent said trailer gate, said catch end having a hook that curves in a direction away from said catch hinge mounting face, said catch being pivotally coupled to the catch hinge and biased away from said mounting face by a spring mechanism positioned between said mounting face and an adjacent side of said catch main body, said adjacent side being opposite a direction of said hook;

said catch, under the biasing force of the spring mechanism, being configured to automatically engage the latch when the trailer gate is moved toward the closed position, said engagement of the catch with the latch holding the trailer gate in a substantially closed position so that an operator can secure the gate closure mechanism without having to physically hold the gate closed; and said catch main body including an arm that extends outwardly from said adjacent side and then rearwardly, a length of said arm being such that an end part of the arm passes through an aperture in a back wall of the trailer so as to be accessible to an operator from outside the trailer by the gate, the operator exerting outward force on the arm to pull the catch away from and out of engagement with the latch to open the gate.

2. The safety catch as set forth in claim 1, wherein said latch has a first side facing and in abutment with the gate and second side opposite the first side and facing outwardly, said second side including an indent having a radiused lip on a front edge and a ramp that slopes upwardly from a base of said lip toward a rear edge of the latch, said catch end hook engaging said radiused lip when the trailer gate is moved toward a closed position and being held thereagainst by the bias of the spring mechanism.

3. The safety catch as set forth in claim 2, wherein said catch end hook slides upwardly and rearwardly along said ramp toward said rear edge of said latch as the trailer gate is moved to a fully closed position, said rear edge including a second radiused lip, said catch end hook engaging said second radiused lip when the trailer gate is fully closed and being held thereagainst by the bias of the spring mechanism and the closed position of the trailer gate.

4. The safety catch as set forth in claim 3, wherein said catch end hook is disengaged from said second radiused lip by applying outwardly directed force against the arm of the catch to compress the spring mechanism while starting to open the trailer gate.

5. The safety catch as set forth in claim 4, wherein upon disengagement of the hook from the second radiused lip, said catch end hook, being biased toward said latch by said spring mechanism, slides downwardly and forwardly along said ramp toward the front edge of the indent where the hook is again engaged with the radiused lip on the indent.

6. The safety catch as set forth in claim 5, wherein said catch end hook is disengaged from said indent radiused lip by applying outwardly directed force against the arm of the catch to compress the spring mechanism while continuing to open the trailer gate.

7. A trailer configured to be pulled by a vehicle, comprising:

a trailer body having an opening through which access to an interior of said trailer body is obtained;

a side load gate hingedly coupled to the trailer body adjacent said opening, said gate in a closed position covering said opening;

a primary gate closure mechanism by which the trailer gate is fully secured in the closed position; and a safety catch for holding the trailer gate in the closed position before the primary gate closure mechanism is secured, said safety catch including, a catch hinge mounted on the body of the trailer and having a mounting face that is generally perpendicular to the trailer gate;

a latch mounted on the trailer gate; and a catch pivotally coupled to the catch hinge and configured to automatically engage the latch when the trailer gate is moved toward the closed position, said catch having a main body extending rearwardly from a pivot end coupled to the catch hinge to a catch end adjacent said trailer gate, said catch being biased away from said mounting face by a spring mechanism, said catch end including a hook that curves in a direction away from said catch hinge mounting face and an adjacent side opposite the direction of said hook, said catch main body including an arm that extends outwardly from said adjacent side and then rearwardly, a length of said arm being such that an end part of the arm passes through an aperture in a back wall of the trailer so as to be accessible to an operator from outside the trailer by the gate, said arm allowing the operator to release the catch from the latch from outside the trailer;

said safety catch automatically engaging as the gate is closed and allowing an operator to secure the primary gate closure mechanism without having to physically hold the gate closed.

8. The trailer as set forth in claim 7, wherein said spring mechanism is positioned between said mounting face and said adjacent side of said catch main body.

9. The trailer as set forth in claim 8, wherein said latch has a first side facing and in abutment with the gate and second side opposite the first side and facing outwardly, said second side including an indent having a radiused lip on a front edge and a ramp that slopes upwardly from a base of said lip toward a rear edge of the latch, said catch end hook engaging said radiused lip when the trailer gate is moved toward a closed position and being held thereagainst by the bias of the spring mechanism.

10. The trailer as set forth in claim 9, wherein said catch end slides upwardly and rearwardly along said ramp toward said rear edge of said latch as the trailer gate is moved to a fully closed position, said rear edge including a second radiused lip, said catch end hook engaging said second radiused lip when the trailer gate is fully closed and being held thereagainst by the bias of the spring mechanism and the closed position of the trailer gate.

11. The trailer as set forth in claim 10, wherein said catch end hook is disengaged from said second radiused lip by applying outwardly directed force against the arm of the catch to compress the spring mechanism while starting to open the trailer gate.

12. The trailer as set forth in claim 11, wherein upon disengagement of the hook from the second radiused lip, said catch end hook, being biased toward said latch by said spring mechanism, slides downwardly and forwardly along said ramp toward the front edge of the indent where the hook is again engaged with the radiused lip on the indent, said catch end hook being disengaged from said indent radiused lip by further applying outwardly directed force against the arm of the catch to compress the spring mechanism while continuing to open the trailer gate.

13. A trailer configured to be pulled by a vehicle, comprising:

a trailer body having an opening through which access to an interior of said trailer body is obtained;

a side load gate hingedly coupled to the trailer body adjacent said opening, said gate in a closed position covering said opening;

a safety catch for holding the trailer gate in a substantially closed position before the gate is fully closed, said safety catch including, a catch hinge mounted on the body of the trailer and having a mounting face;

a catch pivotally coupled at one end to the catch hinge and having a main body and a catch end opposite the pivotally coupled end and adjacent said trailer gate, said catch end including a hook that curves in a direction away from said catch hinge mounting face, said catch main body having an adjacent side facing said catch hinge mounting face;

a latch mounted on the trailer gate, said latch having a first engagement structure and a second engagement structure, said second engagement structure being located nearer the interior of the trailer than said first engagement structure when the gate is closed, the catch hook engaging said first engagement structure when said gate is in the substantially closed position to hold the door in said substantially closed position without an operator having to hold the gate in said substantially closed position, said catch hook engaging said second engagement structure when said gate is fully closed;

a biasing mechanism positioned between said adjacent side of said catch main body and said catch hinge mounting face, said biasing mechanism biasing said catch away from said mounting face so that the hook is biased toward the latch;

the biasing mechanism pressing the hook on said catch into engagement with the first engagement structure on the latch when the trailer gate is moved to the substantially closed position, said engagement holding the door in said substantially closed position without an operator having to hold the gate in said substantially closed position, said hook moving rearwardly toward and engaging with said second engagement structure as an operator fully closes the gate; and said catch main body including an outwardly extending arm with a distal end, a length of said arm being such that said distal end of the arm is accessible to an operator from outside the trailer by the gate, said arm allowing the operator to release the catch hook without having to enter the trailer.

14. The trailer as set forth in claim 13, wherein the biasing mechanism includes a spring element.

15. The trailer as set forth in claim 13, wherein said latch has a first side facing and in abutment with the gate and second side opposite the first side and facing outwardly, said second side including an indent having a radiused lip on a front edge forming said first engagement structure, said indent further having a ramp that slopes upwardly from a base of said lip toward a rear edge of the latch, said second engagement structure including a rear edge of said latch.

16. The trailer as set forth in claim 15, wherein said catch hook slides upwardly and rearwardly along said ramp toward said rear edge of said latch as the trailer gate is moved from the partially closed position to a fully closed position, said rear edge including a second radiused lip, said catch hook engaging said second radiused lip when the trailer gate is fully closed and being held thereagainst by the bias of the spring mechanism and the closed position of the trailer gate.

17. The trailer as set forth in claim 16, wherein said catch hook is disengaged from said second radiused lip by applying outwardly directed force against the arm of the catch to compress the biasing mechanism while starting to open the trailer gate, said catch hook, upon disengagement from the second radiused lip, being biased toward said latch by said biasing mechanism to slide downwardly and forwardly along said ramp to engage with the radiused lip on the indent to hold said gate in said partially closed position.

18. The trailer as set forth in claim 17, wherein said catch hook is disengaged from said indent radiused lip by further applying outwardly directed force against the arm of the catch to further compress the spring mechanism so that the hook can pass over the indent radiused lip while continuing to open the trailer gate.

19. The trailer as set forth in claim 13, wherein said arm extends outwardly from said catch adjacent side and then rearwardly, a length of said arm being such that the distal end of the arm passes through an aperture in a back wall of the trailer.

* * * * *